United States Patent [19]

Roy

[11] Patent Number: 4,732,269

[45] Date of Patent: Mar. 22, 1988

[54] JEWELRY DISPLAY BOX

[75] Inventor: Armand W. Roy, Plainville, Mass.

[73] Assignee: Royal Hinge & Die Co., Inc., Plainville, Mass.

[21] Appl. No.: 22,573

[22] Filed: Mar. 3, 1985

Related U.S. Application Data

[63] Continuation of Ser. No. 835,810, Mar. 3, 1986.

[51] Int. Cl.[4] ..... B65D 79/00

[52] U.S. Cl. ..... 206/45.13; 206/45.18; 206/566; 206/495

[58] Field of Search ..... 206/45.13, 45.14, 45.16, 206/45.18, 45.24, 495, 457, 566, 565; D9/414, 415

[56] References Cited

U.S. PATENT DOCUMENTS

| | | | |
|---|---|---|---|
| 563,581 | 7/1896 | Fletcher | 206/457 |
| 1,641,861 | 9/1926 | Moss | 206/45.18 |
| 1,666,001 | 4/1928 | Catala | 206/45.13 |
| 1,681,092 | 8/1928 | Bulova | 206/45.13 |
| 1,789,852 | 1/1931 | Warner | 206/566 |
| 1,859,401 | 5/1932 | Lengsfield | 206/45.13 |
| 1,906,111 | 4/1933 | Shields | 206/566 |
| 2,052,432 | 8/1936 | Warner | 206/457 |
| 2,464,161 | 3/1949 | Trachtenberg | 206/566 |
| 3,125,221 | 3/1964 | Ay | 206/566 |
| 3,280,972 | 10/1966 | Thomas | 206/495 |
| 3,289,823 | 12/1966 | Weiser et al. | 206/45.13 |
| 3,765,528 | 10/1973 | Parisot | 206/45.13 |
| 3,930,576 | 1/1976 | Stephens | 206/566 |
| 4,043,450 | 8/1977 | Rielly | 206/566 |
| 4,153,154 | 5/1979 | Roscher | 206/566 |
| 4,452,373 | 6/1984 | Pearce | 206/566 |

FOREIGN PATENT DOCUMENTS

| | | | |
|---|---|---|---|
| 215908 | 6/1960 | Austria | 206/45.18 |
| 1632537 | 4/1970 | Fed. Rep. of Germany | 206/45.18 |

OTHER PUBLICATIONS

United States Box Corp., Jan. 1982.

*Primary Examiner*—David T. Fidei
*Attorney, Agent, or Firm*—Salter & Michaelson

[57] ABSTRACT

A display box for an ornamental article including pivotally interconnected top and bottom members, the bottom member having an insert panel removably mounted therein and to which a display panel for receiving an ornamental article for display thereon is pivotally interconnected, the insert panel including a resilient pad with which the display panel engages, the resilient pad urging the display panel in an upwardly inclined direction to a display position upon location of the top member in the open position thereof.

2 Claims, 4 Drawing Figures

JEWELRY DISPLAY BOX

This is a continuation of application Ser. No. 835,810 filed Mar. 3, 1986.

BACKGROUND OF THE INVENTION

The present invention relates to a box construction that has particular application for packaging and displaying an ornamental article in a position that provides for effective visual access thereto when the box is located in a display area in the open position thereof.

The display box of the present invention has specific use in the displaying of jewelry articles, such as bracelets, necklaces, earrings and the like; and although box constructions have been conventionally used for this purpose, these known display boxes have normally included only a flat insert member on which the article of jewelry is placed in position in the bottom member of the box for visual access thereto.

Some efforts have been made to elevate the ornamental article as located in a display box for better visual access; and prior issued patents which are representative of these kinds of box constructions are the U.S. Pat. Nós. to CATALA, 1,666,001; WARNER, 1,769,247; BULOVA, 1,681,092; SHIELDS, 1,906,111; and ROY, 3,937,319. The CATALA patent discloses a jewelry case that is provided with an upwardly extending supporting pad on which a jewelry article is mounted. As the box is closed, the pad is folded downwardly and moves inwardly of the base of the box to the closed position. The movement of the supporting pad to the display position in the CATALA patent is dependent upon a supporting member that is interconnected to the top of the box and defines a somewhat complex structure that is relative expensive to fabricate.

The U.S. Pat. No. to WARNER, 1,769,247, discloses a jewelry box that includes a display pad having an easel-type supporting member attached thereto, the easel mmember being erected upon opening of the top of the box. Here again, the construction of the easel member and the manner in which it is moved to the display position incorporates elements that necessarily increase the cost of the construction of the box and further are not always reliable in use.

The BULOVA U.S. Pat. No., 1,681,092, shows a display box that includes a member for supporting a watch and band for the display thereof and is interconnected to a spring-urged pad. The support member is moved to the elevated position by the spring and pad when the top of the box is opened by the spring member, but because of the rather complex construction of the spring member and the manner in which the spring member engages the pad, the device is not reliable in use and further is not economical in the construction thereof.

The U.S. Pat. No. to SHIELDS, 1,906,111, illustrates a box for displaying jewelry and the like which is somewhat akin to applicant's construction in that a hinge member interconnects a display member to an insert member. However, the SHIELDS box relies upon the hinge to effect the movement of the display member to an upright inclined display position; and because the hinge incorporates a spring element, the movement of the display member to the display position is relatively uncontrolled and tends to locate the display member in a position that is too upright when the top member of the box is opened.

The jewelry display box as disclosed in applicant's prior U.S. Pat. No., 3,937,319, is of a different character than that disclosed in the subject invention, a member in the box for locating a ring in a display position being interconnected to a spring that pivotally interconnects the top and bottom members. Although applicant's prior known box is suitable for displaying of rings as shown therein, it is not normally useful for displaying other kinds of jewelry articles therein.

As will be described, the subject invention provides a unique display box for conveniently displaying articles of jewelry therein in an inclined display position upon the movement of the top member of the box to the open position thereof.

SUMMARY OF THE INVENTION

The present invention relates to a display box for packaging and displaying an article therein. The display box as embodied in the subject invention includes a bottom member or shell having a bottom wall to which upstanding side walls, a front wall, and a rear wall are joined. A top member or shell is hingedly connected to the bottom member and includes a top wall to which side walls and front and rear walls are joined. A display member is located in the bottom member for receiving an article to be displayed thereon, the display member including an insert panel that is received on the bottom wall of the bottom member between the side and front and rear walls thereof. A display panel is hingedly connected to the insert panel for pivotal movement with respect thereto and normally receives the article for display thereon. The insert panel has a resilient pad fixed thereon that is engageable with the display panel and normally urges the display panel to an upwardly inclined display position when the top member is disposed in the open position thereof, thereby locating the article in an inclined display position. The display panel is pivotally movable to a closed position between the top and bottom members upon contact thereof by the top wall of the top member when the top member is moved from the open to the closed position on the bottom member, wherein the display panel is urged into compressing relation against the resilient pad of the insert panel.

Accordingly, it is an object of the present invention to provide a display box for an ornamental article having a bottom member in which an insert panel is located and to which a display panel is pivotally connected, the insert panel having a resilient pad that urges the display panel to an upwardly inclined display position when the top member of the box is moved to the open position thereof.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
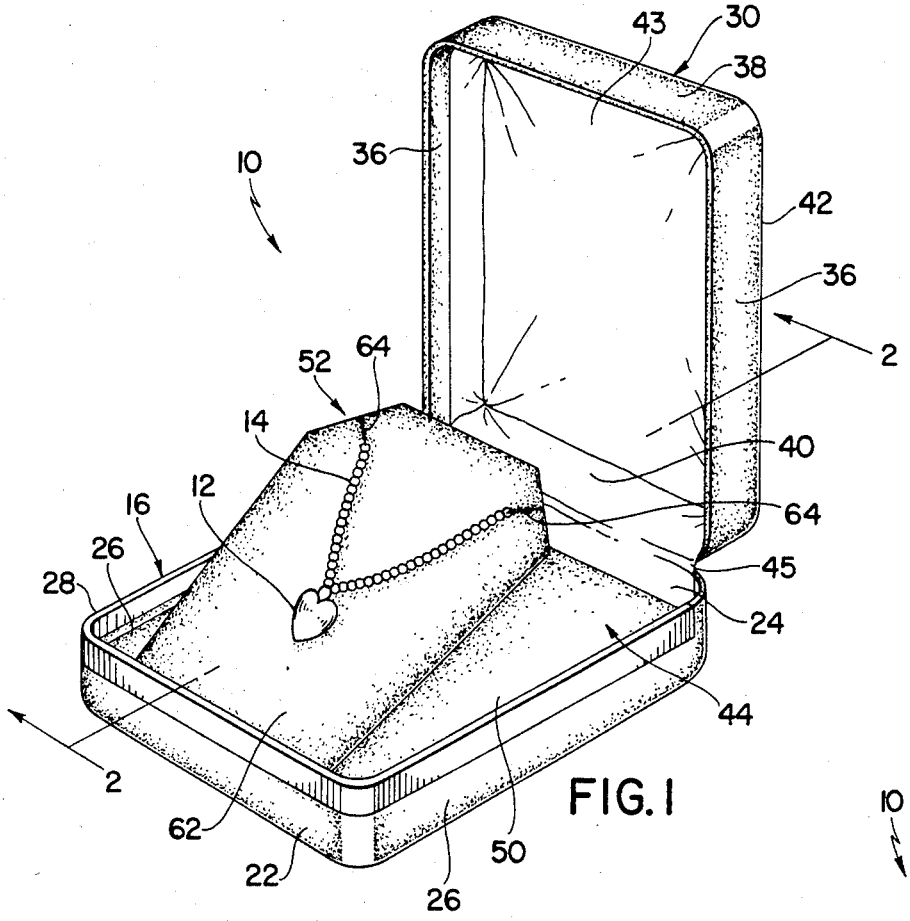
FIG. 1 is a perspective view of the display box as embodied in the subject invention.

Referring now to the drawing and particularly to FIG. 1, the jewelry display box embodied in the present invention is illustrated and is generally indicated at 10. As shown, the jewelry display box 10 has particular application for the packaging and display of small jewelry articles, an example of which is indicated as an ornamental article 12. The article 12 is a small pendant attached to a jewelry chain 14 that is located in the display box 10 in a position of display as shown in FIG. 1, as will hereinafter be described. It is understood that the display box 10 may be utilized for the packaging and display of a variety of ornamental articles, and the shape or configuration of the box may also vary in accordance with the article being displayed therein.

Figure 2:
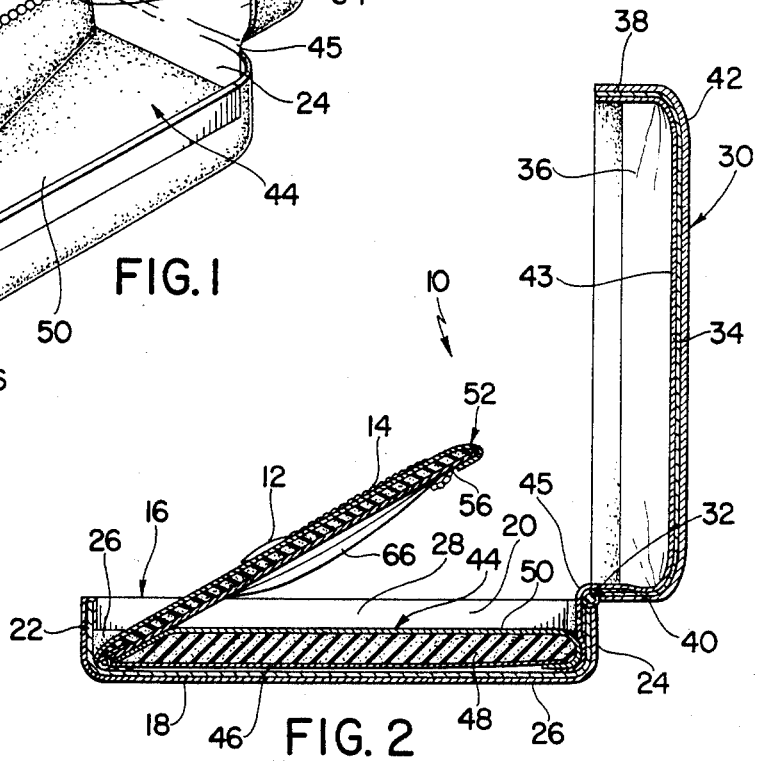
FIG. 2 is a sectional view taken along lines 2—2 in FIG. 1.

Referring now to FIGS. 1 and 2, the display box 10 as shown includes a bottom shell or member generally indicated at 16 that is preferably formed of a metal material and that is drawn to the required shape and configuration as is well known in the art. The bottom shell or member 16 includes bottom wall 18, side walls 20, a front wall 22 and a rear wall 24. A suitable outer ornamental covering such as a velvet or flocked material indicated at 26 overlies the walls of the bottom shell 16 and is fixed thereto in any suitable manner such as by an adhesive. An ornamental metallic rim 28 is mounted on the uppermost edge of the side walls 20 and front wall 22 as is commonly known in the manufacture of jewelry display boxes.

A top shell or member generally indicated at 30 is hingedly interconnected to the bottom member 16 by a hinge 32 that is provided with a spring of common construction for locating the top member 30 in a positive open and closed position relative to the bottom member 16. The top member 30 includes a top wall 34, side walls 36, front wall 38 and a rear wall 40. The top member 30 is also preferably formed of a metal material and is drawn to the required shape and configuration as illustrated. An ornamental covering 42 similar to covering 26 is applied to the bottom member 16 and covers the outer surfaces of the walls of the top member 30. As is also customary in jewelry display boxes, a puff or ornamental interior covering 43 is fixed to the interior surface of the top wall 34 and includes an extension 45 that projects over the hinge 32 and into the bottom of the bottom member.

Figure 3:
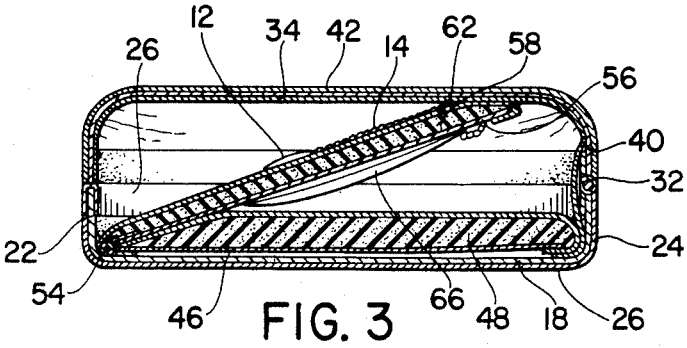
FIG. 3 is a sectional view similar to FIG. 2 but showing the box in the closed position thereof.

As illustrated in FIGS. 1-3, an insert member generally indicated at 44 is located within the bottom member 16 and has a configuration corresponding to that of the bottom wall 26 so as to be located in overlying relation with respect to the full extent thereof. The insert member 44 includes a base element 46 that is normally formed of an inexpensive material, such as cardboard, and mounted on the cardboard base 46 is a resilient pad 48 that is preferably made of a foam material, such as polystyrene. Overlying the resilient pad 48 is a covering 50 that is generally ornamental in appearance and may be formed of a velvet or flocked material similar to the material that overlies the walls of the bottom and top shells 16 and 30 as is well known in the art. In this connection, as will be seen, the covering 50 and the pad 48 cooperate to define a padding layer on the base 46 which imparts a padded appearance to the insert member 44.

Figure 4:
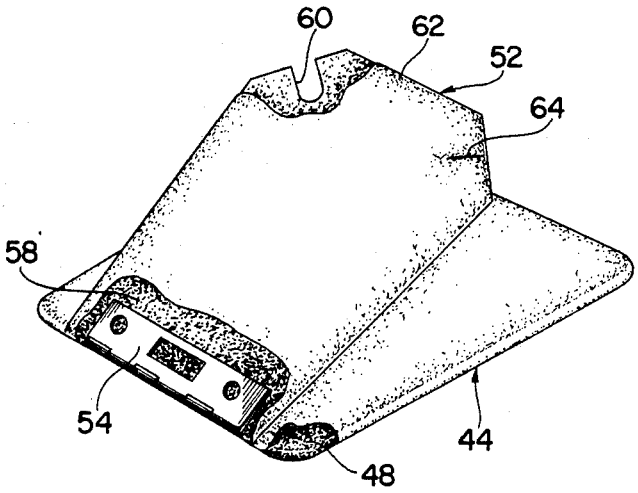
FIG. 4 is a perspective view of the insert member and the display member pivotally connected thereto.

As shown in FIG. 4, a display panel generally indicated at 52 is pivotally connected to the insert panel 44 by a hinge member 54. The display panel 52 also includes a cardboard base 56 that has a reducing taper from the upper or outer portion to the inner or lower portion thereof to which the hinge 54 is attached. The reducing taper of the display panel 52 produces a configuration that provides that the display panel 52 has a corresponding width and length that is somewhat less than the width and length of the insert panel 44 to which it is pivotally connected. Located in overlying relation on the display panel base 56 is a foam piece 58 in which corner slots 60 are formed. Overlying the foam piece 58 is a velvet or flocked covering material 62, the covering 62 also corresponding to the type of material and the color thereof that is located on the resilient pad 48 of the insert panel 44 and that overlies the walls of the bottom and top shells 16 and 30. As further shown in FIG. 4, the outer corners of the covering 62 are slit as indicated at 64 to accommodate the chain 14 to which the pendant 12 is attached and that is packaged for display in the box 10. As further shown in FIG. 2, a small envelope 66 may be attached to the rear side of the base 56 of the display panel 52 for receiving the excess portions of the chain 14.

In use of the display box 10 as embodied in the subject invention and as shown in FIGS. 1-3, the insert panel 44 and the display panel 52 pivotally attached thereto are received in the bottom member 16. Since the display panel 52 is pivotally joined to the insert panel 44 at the forwardmost end thereof, the resilient pad 48 of the insert panel 44 urges the insert panel 52 to an upper inclined display position when the top member 30 is located in the open position thereof. When the top member 30 is moved to the closed position thereof as illustrated in FIG. 3, the top wall 34 engages the display panel 52 on the closing movement thereof, and the display panel is then pivotally moved downwardly with the top wall 34 into the position shown in FIG. 3. In this position, the surface of the display panel 52 that is adjacent to the hinge member 54 engages the forward portion of the insert panel 44 and tends to compress the resilient pad 48. In the closed position, the display box 30 can be stored with the ornamental article 12 therein and/or shipped as required. When it is desired to display the ornamental article 12 as located on the display panel 52, the top member 30 is moved to the open position as shown in FIG. 2, and the resiliency of the pad 48 of the insert member 44 as it returns to its normal position urges the display panel 52 upwardly into a display position to provide effective visual access to the ornamental member 12 as illustrated in FIG. 1.

It is seen that the display panels 52 and insert member 44 are relatively inexpensive to make and secure together, yet they provide a convenient and simple means by which the ornamental article as located in the display box is urged into a display position for better visual access thereto.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A display box for packaging and displaying an article therein, comprising a bottom member having a bottom wall to which upstanding side walls, a front wall and a rear wall are joined, a top member hingedly connected to said bottom member and including a top wall to which side walls and front and rear walls are joined, and a display member located in said bottom member for receiving an article to be displayed thereon, said display member including an insert panel that is received on the bottom wall of said bottom member between the side and front and rear walls thereof, and a display panel that is hingedly connected to said insert panel for pivotal movement relative thereto and adapted for receiving the article for display thereon, the pivotal connection of said display panel to said insert panel being located adjacent to and extending in parallel relation with respect to the front wall of said bottom member, said insert panel including a substantially rigid base that is dimensioned to be received on the bottom wall of said bottom member so that said base extends between the side, front and rear walls of said bottom member, and a padding layer on said base covering substantially the entire upper surface thereof, said padding layer including a resilient foam pad received on said base and substantially covering the entire upper surface thereof and a fabric layer secured to said base and substantially covering said foam pad, said padding layer imparting a padded appearance to said insert panel and engaging said display panel adjacent to the pivotal connection between said display panel and said insert panel to normally urge said display panel to an upwardly inclined display position to locate said article in an inclined display position, said display panel being pivotally movable to a closed position between said top and bottom members upon contact thereof by the top wall of said top member when the top member is moved from the open to the closed position on said bottom member, the portion of said padding layer which is adjacent to the pivotal connection between said display panel and said insert panel being resiliently compressed by said display panel when said display panel is moved to the closed position thereof.

2. A display box as claimed in claim 1, said display member insert panel fitting snugly within said bottom member to fully cover the bottom wall thereof, and said display panel as pivotally connected to said insert panel having dimensions that enables said display panel to occupy less than the total length and width of said insert panel when moved to the closed position by said top member to provide for positive movement of said display panel to the open and display positions thereof.

* * * * *